US005514078A

United States Patent [19]

Palmer

[11] Patent Number: 5,514,078

[45] Date of Patent: May 7, 1996

[54] DUAL PULSATING FLUID DISTRIBUTOR FOR USE WITH HYDRO-MASSAGE TABLE

[76] Inventor: Sidney C Palmer, 23001 137th Ave. N., Rogers, Minn. 55374

[21] Appl. No.: 147,962

[22] Filed: Nov. 4, 1993

[51] Int. Cl.[6] ..... A61H 7/00

[52] U.S. Cl. ..... 601/149; 601/148

[58] Field of Search ..... 239/251; 601/148–150, 601/154–157, 158, 160

[56] References Cited

U.S. PATENT DOCUMENTS

| | | | |
|---|---|---|---|
| 2,991,942 | 7/1961 | Rosekranz | 239/251 X |
| 3,193,203 | 7/1965 | Crow | 239/251 X |
| 3,317,934 | 5/1967 | Hinrichs | 5/349 |
| 3,420,226 | 1/1969 | Berry | 128/24.1 |
| 3,512,713 | 5/1970 | Carlyon, Jr. | 239/251 X |
| 3,915,182 | 10/1975 | Payne | 239/251 X |
| 4,066,072 | 1/1978 | Cummins | 128/40 |
| 4,077,074 | 3/1978 | Fogel | 5/370 |
| 4,112,943 | 9/1978 | Adams | 128/24.1 |
| 4,120,062 | 10/1978 | Anderson | 5/370 |
| 4,258,706 | 3/1981 | Shank | 128/33 |
| 4,330,893 | 5/1982 | Matsui | 5/451 |
| 4,339,833 | 7/1982 | Mandell | 4/542 |
| 4,358,862 | 11/1982 | Altman et al. | 4/542 |
| 4,422,191 | 12/1983 | Jaworski | 4/496 |
| 4,502,168 | 3/1985 | Jaworski | 4/496 |
| 4,559,653 | 12/1985 | Mathews | 4/541 |
| 4,564,965 | 1/1986 | Goodwin | 5/445 |
| 4,607,405 | 8/1986 | Ellis et al. | 5/451 |
| 4,635,620 | 1/1987 | Ricchio | 128/64 |
| 4,637,083 | 1/1987 | Goodwin | 601/158 X |
| 4,684,486 | 8/1987 | Ricchio | 261/36.1 |
| 4,713,853 | 12/1987 | Ricchio | 5/422 |
| 4,731,887 | 3/1988 | Henkin | 4/541 |
| 4,757,562 | 7/1988 | Mützell | 4/615 |
| 4,757,808 | 7/1988 | Effler, Jr. | 128/66 |
| 4,763,367 | 8/1988 | Henkin et al. | 4/542 |
| 4,768,249 | 9/1988 | Goodwin | 5/453 |
| 4,777,802 | 10/1988 | Feher | 62/3 |
| 4,813,605 | 3/1989 | Fuller | 239/251 X |
| 4,835,802 | 6/1989 | Purcey et al. | 601/148 X |
| 4,837,880 | 6/1989 | Coffman | 5/451 |
| 4,923,248 | 5/1990 | Feher | 297/180 |
| 4,964,371 | 10/1990 | Maeda et al. | 123/41.1 |
| 4,976,256 | 12/1990 | Marlin et al. | 128/64 |
| 5,051,673 | 9/1991 | Goodwin | 318/481 |
| 5,054,474 | 10/1991 | Jacob et al. | 128/66 |
| 5,074,286 | 12/1991 | Gillaspie et al. | 601/148 |
| 5,078,206 | 1/1992 | Goetz, Jr. | 165/125 |
| 5,129,473 | 7/1992 | Boyer | 180/68.1 |

FOREIGN PATENT DOCUMENTS 2115190 10/1972 Germany .

*Primary Examiner*—Robert A. Hafer
*Assistant Examiner*—Brian E. Hanlon
*Attorney, Agent, or Firm*—Janet P. Schafer

[57] ABSTRACT

A fluid distributor for use in a fluid-filled bladder of a massage table in which a nozzle, mounted for rotatable motion, directs the fluid in an upward direction, a curved blade fixedly attached and extending laterally from the nozzle, causes a second motion to be introduced into the fluid. A temperature stabilizer is provided whereby fluid in the fluid-filled bladder of the massage table can be cooled dissipating heat generated by continuous action of a pump used to pressurize the fluid within the bladder.

5 Claims, 5 Drawing Sheets

DUAL PULSATING FLUID DISTRIBUTOR FOR USE WITH HYDRO-MASSAGE TABLE

BACKGROUND

This invention relates to massage tables and is particularly concerned with spinal massage tables of the type where motion in a fluid-filled bladder is transmitted to the user's body. The invention is particularly concerned with novel fluid distributors and means for stabilizing fluid temperature within the massage table.

It is known that a large portion of the population experiences health problems associated with bad backs. Currently their recourse is to undergo surgery, seek chiropractic assistance or massage therapy on a regular basis, or live with the pain. One means to alleviate this pain has been the use of massage tables, usually in the chiropractic setting.

Massage tables having a fluid-filled bladder or bladders within a cabinet, or table, are known, see U.S. Pat. No. 5,074,286, Gillaspie et al. Pulsating motion is made by circulating a fluid, mainly water, through a series of jets or nozzles within a waterbed-type bladder. Present practice includes the use of pistons, pumps, sonic means, etc. to introduce pulsating motion into the fluid within the bladder, the fluid transmitting the pulsating motion to the surface of the bladder where it can affect the user.

Hydrotherapy baths also have been used putting the user in direct contact with pulsation fluid. These include whirlpool baths and spas.

A shortcoming of the current practice is that the units are designed for institutional use and as a result are physically large and heavy and prohibitively expensive for the individual to purchase for home use. Recently, whirlpool baths and spas have been designed for home use but still require large initial expenditure including addition of a room for installation of the whirlpool bath or spa in the home. Also, hydrotherapy baths require preparation time both before and after use on the part of the user.

An additional shortcoming in the current practice has been the inability to recreate the effect of manual massage by mechanical means.

A further shortcoming of the current practice has been the difficulty and expense associated with stabilizing the fluid temperature in such a device. It has been a problem to economically dissipate excess heat produced by the circulating pump.

A further shortcoming has been the inability to control the amount of fluid circulating through the bladder to allow the user to change the strength of the pulsating motion.

A further shortcoming has been the noise associated with the fluid circulating through the pump and related tubing.

For the foregoing reasons, there is a need for a massage table that can be produced and installed for quiet home use, that provides a distributor for variable pulsating action that more closely resembles manual massage treatments, that allows the user to individually select the strength of pulsating action and provides means for economically stabilizing the fluid temperature within the unit.

SUMMARY

The present invention is directed to a pulsating hydromassage table that satisfies these needs. A massage table is provided having a fluid-filled bladder, means for supporting the bladder, inlet and outlet tubing means for circulating the fluid within the bladder, a pump for circulating the fluid through the bladder, and at least one fluid distributor, mounted for rotatable motion on the tubing means within the bladder, the fluid distributor rotating in response to passage of fluid therethrough, for providing dual pulsating motion of the fluid to the user.

A massage table is provided having a fluid-filled bladder, means for supporting the bladder, inlet and outlet tubing for circulating the fluid within the bladder, a pump for circulating the fluid through the bladder, a temperature stabilizer having a configuration of tubing, on which are mounted a plurality of fins, means for circulating the fluid through the temperature stabilizer for conducting heat away from the fluid circulating through the finned tubing.

A massage table is provided having a fluid-filled bladder, means for supporting the bladder, inlet and outlet tubing for circulating the fluid within the bladder, a pump for circulating the fluid through the bladder, a fluid distributor, mounted for rotatable motion on the tubing means within the bladder, the fluid distributor rotating in response to passage of fluid therethrough, for providing dual pulsating motion to the user, and a temperature stabilizer for cooling the fluid circulated away from the bladder, the temperature stabilizer having an array of finned tubing and a blower for blowing ambient air over the finned tubing for conducting heat away from the fluid circulating through the finned tubing.

An important advantage of the present invention is that a massage table with these embodiments is small enough that it does not require a room of its own, is light weight so that no structural considerations need be made and therefore, is appropriate for home use. Also, because it is more economically produced, increased numbers of people are able to purchase such a device for home use.

An important advantage of an embodiment of the present invention is the addition of a novel fluid distributor. The distributor consists of a nozzle having an opening at one end for the passage of fluid therethrough providing a first pulse. Associated with the nozzle is a blade which is fixedly attached, in a generally parallel plane, to the nozzle. This inverted C-shaped blade catches the fluid sending it upward as a second pulse. The blade acts as a counter-balance to the nozzle increasing the stability of the nozzle in position atop the fluid distributor. Additionally, the blade acts as a brake to the rotating nozzle. Because of the proximity of the distributor to the upper edge of the bladder, both the first pulse, caused by the fluid exiting the nozzle, and the second pulse, caused by the interaction of the blade with the surrounding fluid, is tactually experienced by the massage table user. An embodiment of this invention provides the user with a dual-pulsating massage effect that will penetrate a muscle mass in a very compact table.

Another advantage of an embodiment of this invention is the temperature stabilizing feature. Continuous use of the pump can add heat to the fluid circulating therethrough. The heat dissipator can be used to dissipate the heat so generated.

A further advantage is the tactual stimulation the user perceives upon use of a massage table with the embodiments of the present invention. This stimulation closely resembles the tactual stimulation received from manual massage. This is an important advantage for people suffering from chronic back pain.

A further advantage is the noise reduction gained by the use of the novel tubing connection by which fluid is circulated through the temperature stabilizer. This allows one pump to circulate the fluid throughout the system, including through the temperature stabilizer.

Variable massage pressures are achieved by use of a solenoid-activated bypass valve which, when open, causes fluid to bypass being sent into the bladder. Additional solenoid activated valves and associated bypass tubing can be added to further reduce fluid flow within the bladder. This variable massage pressures re-create the sensation of manual massage to the user, an important advantage to those suffering from chronic back pain.

BRIEF DESCRIPTION OF THE DRAWINGS

Understanding of the invention will be enhanced by referring to the accompanying drawing, in which like numbers refer to like parts in the several views and in which.

DETAILED DESCRIPTION OF THE PREFERRED EMBODIMENTS

Understanding of the invention will be further enhanced by referring to the following illustrative but nonlimiting examples. Conventional tubing and couplings are included in this description generally have not been identified. Where important for understanding the invention, conventional tubing and couplings have been identified.

Definitions.

A jet has an input opening larger than that of the output opening thereby creating additional force in the outgoing fluid, air, or the like, passing there-through. The fluid distributor of the present invention has an input opening and an output opening of similar size.

Figure 1:
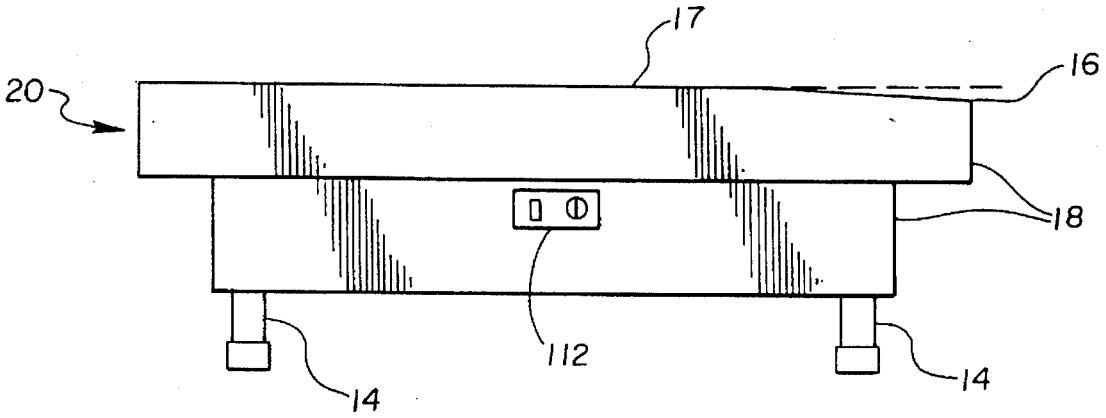
FIG. 1 is a side view of a massage table for use with embodiments made in accordance with the invention.
Figure 2:
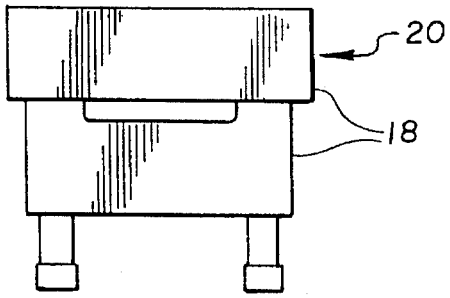
FIG. 2 is an end view of the massage table of FIG. 1.
Figure 3:
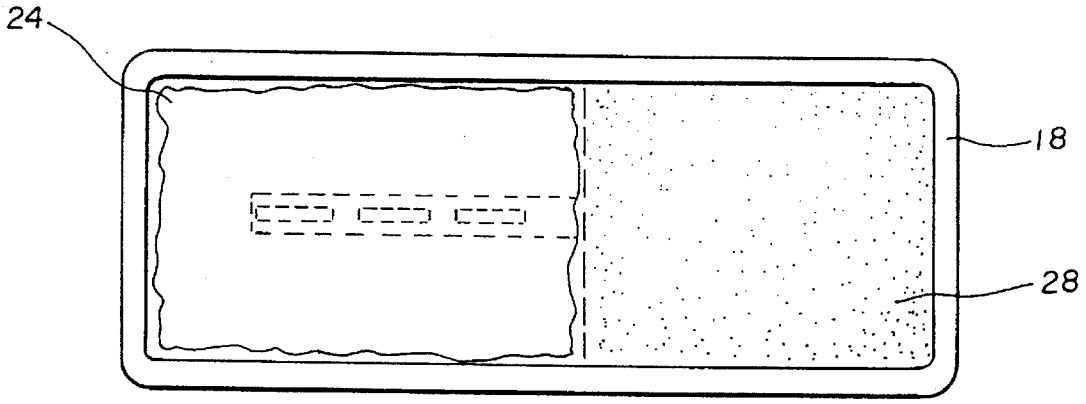
FIG. 3 is a top plan view of the massage table of FIG. 1.
Figure 4:
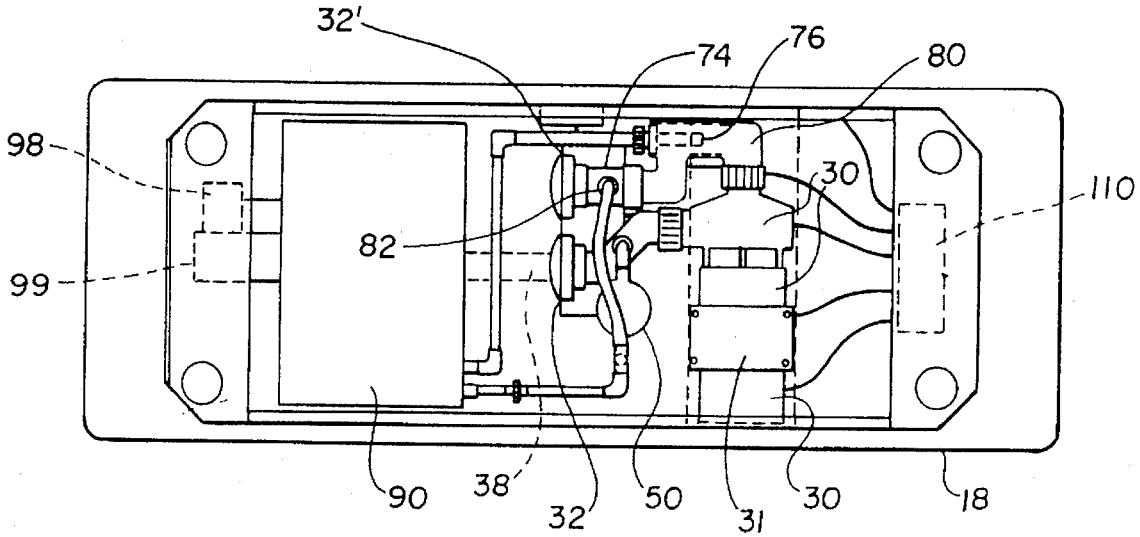
FIG. 4 is a bottom plan view of FIG. 1.
Figure 5:
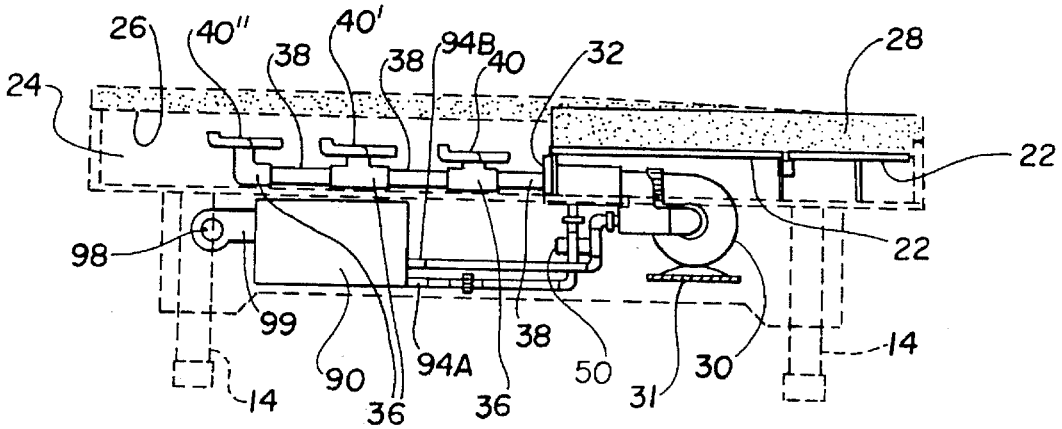
FIG. 5 is a schematic side view of the invention of FIG. 1, with portions broken away for ease of understanding.

Massage tables 20, like the one shown generally at FIG. 1, have a fluid-filled bladder 24, the fluid generally being water, and means for circulating the fluid throughout the bladder 24. A pulse is introduced into the fluid-filled bladder 24 by means of circulating fluid through a pump 30 and then into the fluid-filled bladder 24. A circulating pump 30, like that associated with swimming pools, whirlpool baths, spas and the like, pushes fluid through a jet, nozzle, or the like, creating a pulse which is tactually perceivable by the user when laying the user's body on the massage table An embodiment of the present invention utilizes a fluid distributor 40, in place of a jet, to introduce a pulse into the fluid held by the bladder 24 within a massage table 20. Because of the novel design of the fluid distributor 40, two pulses are created by a single rotation of the fluid distributor nozzle The placement of the fluid distributor 40 in close proximity to the upper surface 26 of the bladder 24, shown at FIG. 5, allows both pulses to be tactually perceived by the user. The addition of a solenoid-activated valve 50 varies the pressure of the pulses. The valve 50 can be activated, opening the valve, not shown, allowing fluid to bypass the bladder 24 thereby reducing the pressure of the pulse within the bladder 24. The addition of a temperature stabilizer 90 is used to dissipate excess heat created by continuous use of the pump 30. The temperature stabilizer 90 contains an array of copper tubing 94 with the addition of a plurality of aluminum fins 96 mounted thereon. A blower 98 is used to circulate air between the array of finned tubing 94 cooling the fluid held therein.

The massage table 20 with embodiments of the present invention utilizes a fluid-filled bladder 24 similar to that used in conventional waterbeds but of smaller dimensions than that used in previous massage tables. U.S. Pat No. 4,635,620, Ricchio, for instance provides for a waterbed that holds 160 gallons of fluid. The present invention provides a bladder 24 that holds a range of between 10 and 25 gallons of fluid. In actual use conditions, a bladder holding about 22 gallons has been utilized with best results.

Having a smaller bladder means the unit weighs less when in use and fluid-filled. The cabinet 18 supporting the bladder 24 is smaller than currently used cabinets. This smaller size and reduced weight provides a massage table adaptable for a home environment. Structural changes to the home are not required prior to home use of this embodiment of the present invention.

The bladder 24 is smaller because it is used to support and massage only the upper torso of the user, not shown. The lower torso, including the buttocks and legs, are supported by the frame 22 of the cabinet be. For comfort, foam padding 28 has been added, and can be varied in thickness as needed.

In actual use conditions, the cabinet 18 for supporting the bladder 24 is made of plywood although other low-cost, easily cut materials can be used. The first end 16 of the cabinet 18, the end where the user's feet would be placed when the massage table is in use, is lower for easy access, illustrated by broken line at FIG. 1. This feature allows the user to ascend and descend the massage table with ease. In actual use conditions, a 1 inch difference between the highest edge 17, and the first end 16, or lowest edge of the cabinet, has been used with best results.

Figure 7:
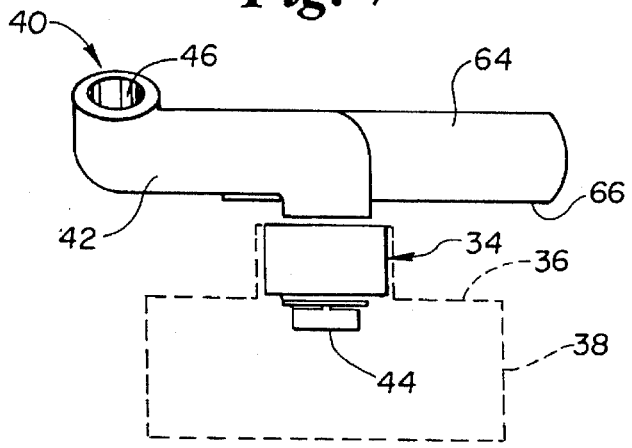
FIG. 7 is a fluid distributor made in accordance with the invention.
Figure 8:
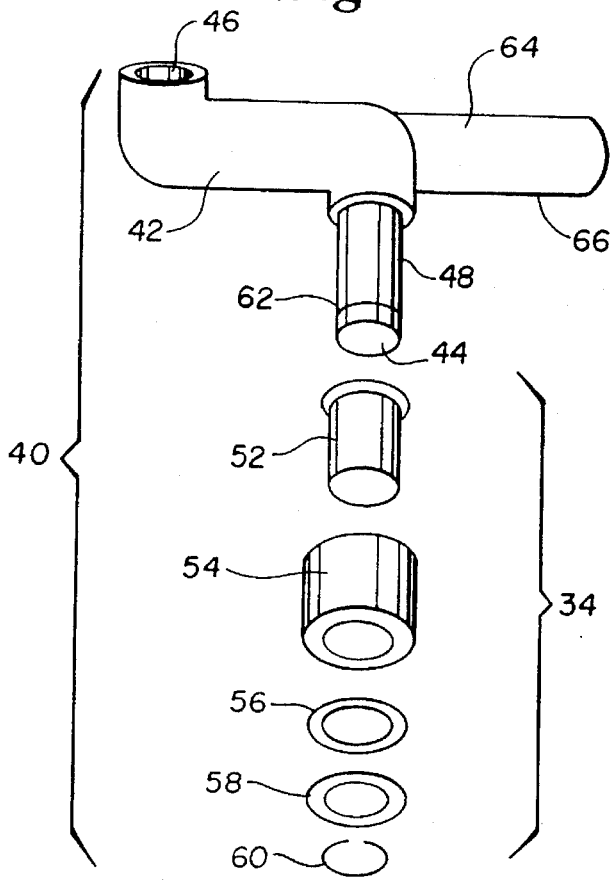
FIG. 8 is an exploded view of the fluid distributor of FIG. 7.
Figure 9:
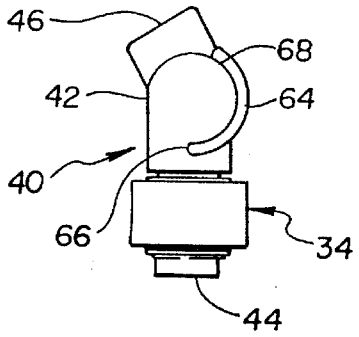
FIG. 9 is a side view of the fluid distributor of FIG. 7.

The fluid distributor 40 of the present invention, shown in detail at FIGS. 7, 8, 9 consists of a nozzle 42 configured in an S-shape, having inlet 44 and outlet 46 for passage of the fluid therethrough. In actual use conditions, two 90° elbow PVC tubings are positioned and adhered together to provide a the S-shaped nozzle 42 with the outlet 46 at about 60° from the vertical plane, as shown at FIG. 9. Extending in a downward direction from the nozzle 42 is a stem 48, also of PVC tubing and having an inlet 44 of a diameter the same as the inside diameter of the outlet tube 46. Other materials, such as metal, could be used in place of PVC tubing. This stem 48 provides the pivot about which the fluid distributor 40 rotates once positioned on a coupling 36 attached to the supply tubing 38. The stem 48 carries a nylon bearing 52 which fits around the stem 48 and allows free rotation of the stem 48 within the bearing 52. Other material can be used or some form of roller bearing could be used as a means to reduce friction and wear at this stem 48. A PVC bushing 54 is mounted over the nylon bearing 52, surrounding the stem 48, increasing the stability of the fluid distributor 40 during rotation. A pair of Teflon® washers 56,58 are provided, the first washer 56 fitting loosely on the stem 48 allowing free rotation of the stem 48 and associated fluid distributor 40 within the bushing 54, the second washer 58 fitting tightly on the stem 48 providing a barrier to the surrounding fluid while rotating freely with the rotating stem 48. The Teflon® washers 56,58 abut each other, one rotating and the other staying stationary. Any friction therebetween is reduced because of the composition of the washers themselves. This stem-surrounding assembly 34 is retained in place on the stem 48 by means of a retainer clip 60, or spring, which fits into a groove 62 formed into the surface of the stem 48.

Extending laterally from the nozzle 42 is a blade 64 of inverted C-shaped configuration. This blade 64 acts as a wing catching and deflecting the surrounding fluid. Because the bottom edge 66 of the C-shape extends to a vertical axis, shown in phantom at FIG. 9, and the upper edge 68 of the C-shape does not extend to the vertical axis, the fluid so deflected is pushed by the blade 64 in an upward direction.

The fluid escaping from the nozzle 42 proceeds outwardly at the about 60° angle and is deflected upwardly by the surrounding fluid. The close proximity of the upper surface 26 of the bladder 24 provides immediate downward thrust that strikes the blade 64 and is deflected upwardly by the turning blade 64. The combination of this pulsing of the fluid upwardly, downwardly and upwardly again provides the unique massage sensation to the user.

In actual use conditions, three fluid distributors 40,40',40" are provided for mounting along a supply tubing 38 held within the fluid-filled bladder 24. This supply tubing 38 is generally parallel to the spine of the user when positioned for use, not shown. The fluid distributor 40" furthest away from the pump 30 is one inch closer to the upper surface 26 of the bladder 24 than is the fluid distributor 40 closest to the pump 30. The middle fluid distributor 40' is intermediate in height between these two end fluid distributors 40, 40". A problem with the current practice has been the fragility of the jets or nozzles. U.S. Pat. No. 5,074,286, Gillaspie utilizes a gear-driven jet. If this gear-driven jet is impacted, for instance the user lies on it, the gear is damaged. For that purpose, the jets, etc. were positioned far away from the user's body. The present embodiment of this invention provides a fluid distributor 40 that resists deformation caused by direct contact between the user's body and the distributor. This allows the positioning of the fluid distributor 40 in closer proximity to the body of the user, increasing tactual perception of the user of both pulsations caused by a single rotation of this fluid distributor 40. In actual use conditions, the fluid distributors 40,40',40", rotate independently of each other contributing to the unique massage sensation perceived by the user.

Additionally, Gillaspie must have a distance between the jets and the user's body to create the pushing and pulling upon the user's body, or "traction". To attain this traction, the fluid flowing from the jets must overlap. Also, the jets of Gillaspie rotate slowly, about 10 to 15 revolutions per minute, whereas in this embodiment of the present invention, the fluid distributors rotate approximately 200 times per minute. This speed of rotation contributes to the unique massage effect attained by use of the fluid distributors of the present invention.

Figure 6:
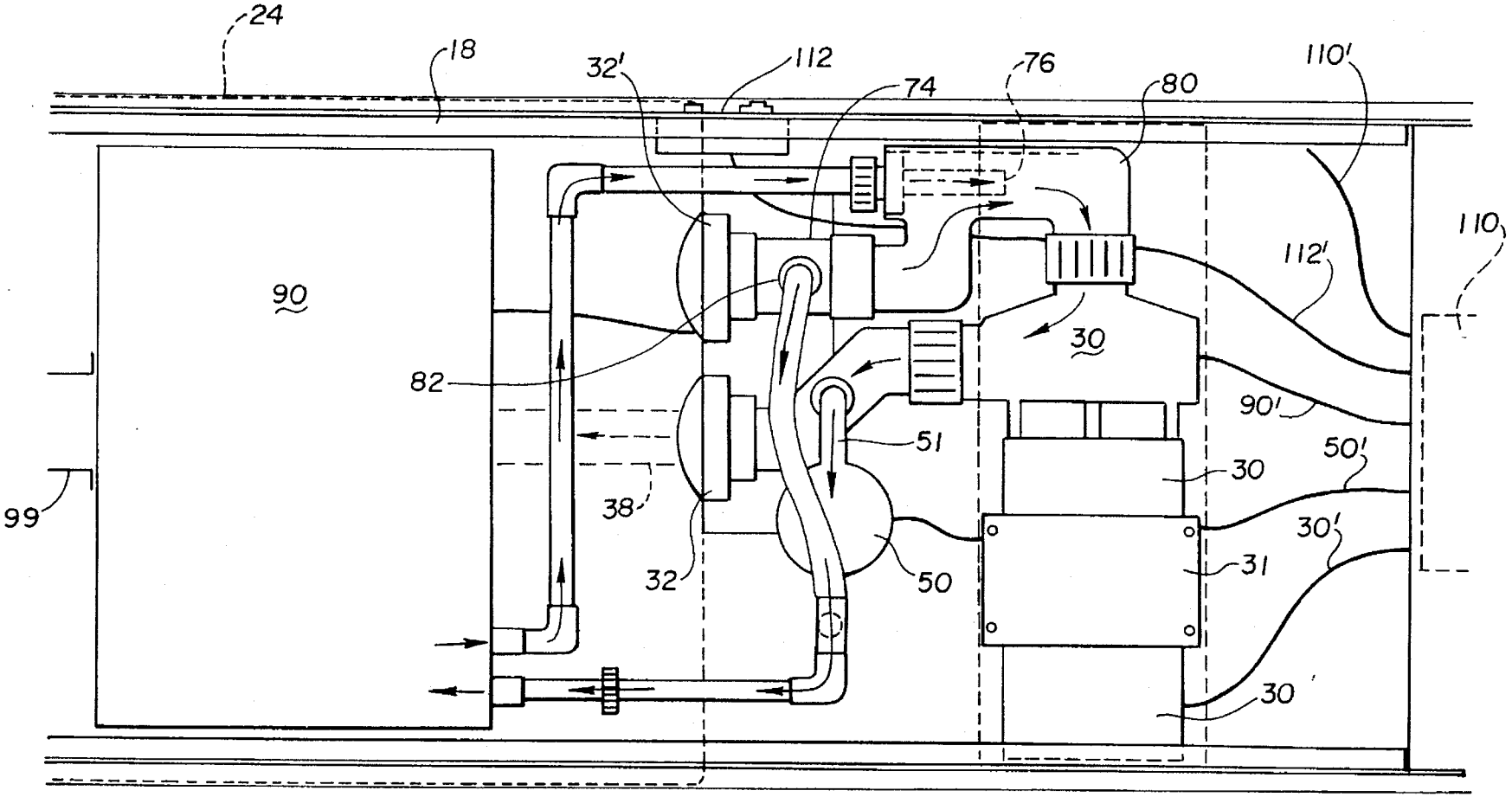
FIG. 6 is an enlargement of the bottom plan view of FIG. 4, indicating the configuration of elements below the bladder.

The pump 30 is operated at full speed. Pressure can be reduced by means of a bypass installed "upstream" of the fluid distributor. A solenoid-activated valve 50, of the type used in automatic lawn sprinklers, is used to control the volume of fluid being pulsed throughout the bladder 24. When the solenoid-activated valve 50 opens, it provides an alternate route for the fluid to pass through rather than flowing into the bladder 24. As shown in FIG. 6, the solenoid-activated valve 50 is connected by tubing at a first end 51 to the fluid flowing out from the pump 30 towards the bladder 24. This fluid may be diverted into the temperature stabilizer 90 for dissipation of excess heat.

When a massage table 20 having the embodiments of the present invention is continuously used, heat, generated from use of the circulating pump 30, can increase the temperature of the circulating fluid above desirable limits. Heat is created by friction when a fluid is pressurized and forced through tubing. To prevent this heat from accumulating, a temperature stabilizer 90 can be added to the massage table 20. This temperature stabilizer 90 consists of at least one layer 92 of copper tubing 94 with aluminum fins 96 stacked along the length of the tubing 94, shown at FIG. 11. These copper tubes 94 are connected using 90° elbows and tubing 94. The tubing 94 is arranged so the fluid enters the lower front tube 94A and exits from the upper rear finned tube 94B. This allows for total drainage for shipping in cold weather. The finned tubes 94 are enclosed in a container with sealed ends, bottom and top. The rear panel 104 has an opening to accept an air blower 98, shown in FIG. 11, of sufficient size to provide the cubic feet of air required to cool the finned tubes. The front panel 106 has an opening 114 sized to allow air flow through a complete stack of finned tubes. On each end of the tubes, a dense foam 108 is used to block air from flowing around the ends rather than through the fins on the tubes. There is a space 116 where the air enters the rear from the blower and the first stack of finned tubes 94, allowing the air to distribute more evenly before passing through the first stack of tubes 94. This is repeated between each stack of tubes 94 to allow for the most efficient manner of using the air flow for cooling. Additionally, once the air has passed through the stabilizer 90, the air is expelled into the pump 30 chamber where the passage of air over and around the pump 30 helps to cool the pump 30. Without this feature, the pump 30 would overheat during continuous operation.

Figure 11:
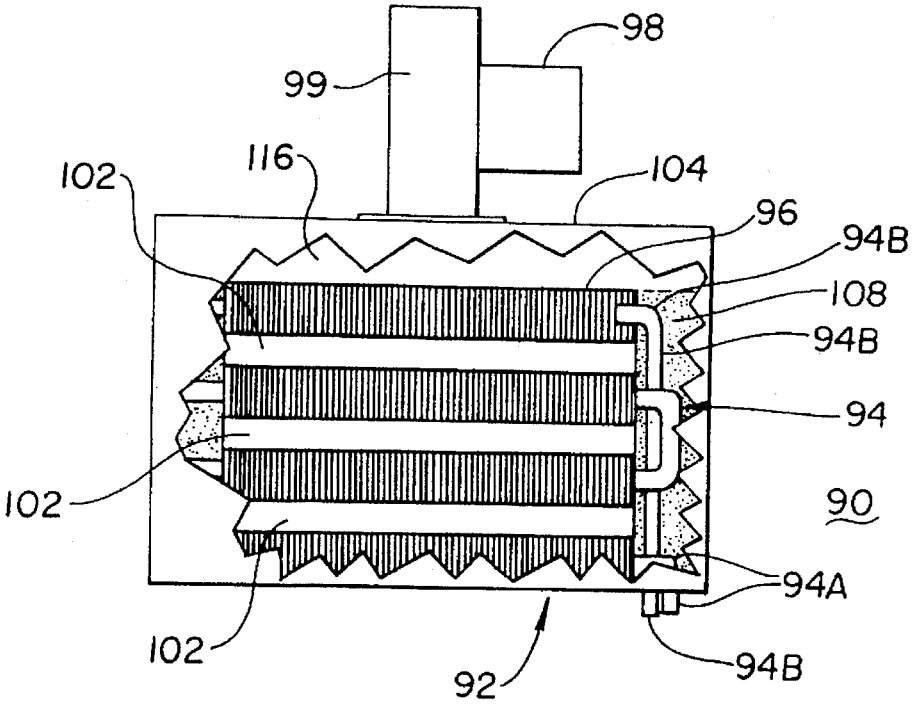
FIG. 11 is a cross-sectional top plan view, taken along the lines 10—10 of FIG. 10, of the temperature stabilizer of FIG. 10 with portions broken away for ease of understanding.
Figure 10:
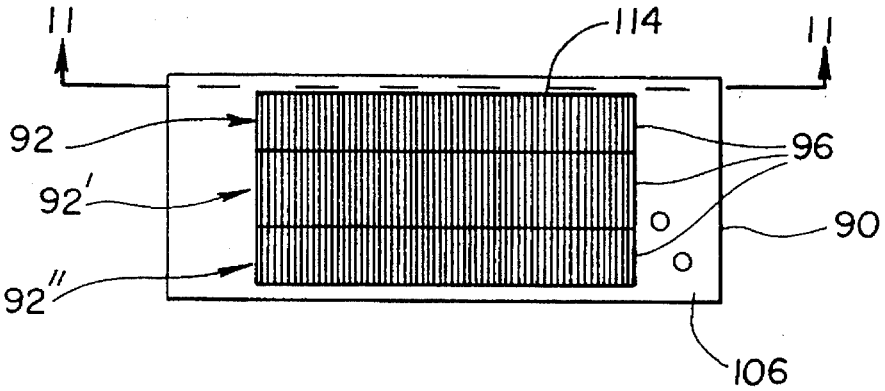
FIG. 10 is a front view is a of the temperature stabilizer, made in accordance with the invention.

In one embodiment of the present invention, three layers 92,92',92" of finned tubing are used. In actual use conditions, each layer 92, has four courses of finned tubing 94, and these finned tubings 94 are positioned to maintain a space 102 between the courses of finned tubing 94. The fins 96 of one layer 92 abut the fins 96 of an adjoining layer 92', as shown at FIG. 10. The blower 98 can be mounted in a housing 99 within the massage table cabinet for directing blown air across these finned tubes 94, as shown at FIG. 11.

Fluid, diverted from circulating through the pump 30, flows into the temperature stabilizer 90. Because the tubing leads from the bottom of a chamber 74 between the bladder 24 and the pump 30, the chamber 74 being of greater diameter than the tubing immediately before the pump 30, the fluid escapes the pump 30 by flowing downwardly from the chamber 74 and away from the pump 30. After the fluid has been circulated through the temperature stabilizer 90, the fluid flow away from the temperature stabilizer 90 is aided by the creation of a vacuum within a nipple 76, shown in detail at FIG. 6, by which the fluid flows from the temperature stabilizer 90 into the pump 30. Fluid flowing around the nipple 76 on its way from the chamber 74 into the pump 30 creates this vacuum pulling the fluid from the temperature stabilizer 90. This eliminates the need for a second pump to achieve fluid flow from the temperature stabilizer 90 to the pump 30, and further reduces noise of operation. The temperature stabilizer 90 solves the previous problem of over-heating of fluid in a bladder-containing massage table.

In use, the pump 30 circulates fluid through tubing extending into a fluid-fillable bladder 24. Drain fittings 32,32', like those used in swimming pools and whirlpool baths, etc. are used to provide a water-tight connection at the point of entry of the tubing into the bladder, drain fitting 32 connecting tubing leading to the bladder 24 from the pump 30, drain fitting 32' connecting the bladder 24 to tubing leading back to the pump.

After the bladder 24 is filled with fluid, the fluid circulates from the pump 30 through conventional tubing to the supply tubing 38 for flow out the fluid dissipators 40,40',40" into the bladder 24. The fluid is forced through the tubing by the pump 30 pushing the fluid. Movement of the fluid out the fluid dissipator 40,40',40" causes it to rotate about its pivot creating a pulse of fluid that is forced upwardly from the fluid dissipator outlet 46. A second pulse of fluid is created by action of the blade 64 pushing against the surrounding fluid as the fluid dissipator 40,40',40" rotates. This pulse is directed in an upwardly direction because countering fluid forces surrounding the fluid distributor 40,40',40" forces the fluid flowing out from the fluid dissipator 40,40',40" upwards to the area of least resistance, namely, the area near the upper surface 26 of the bladder 24. The dual-pulsing action more closely re-creates the sensation of a manual massage to the user.

The blade 64 also serves as a brake creating resistance to slow the rotation of the nozzle 42. If the nozzle were to rotate too quickly, say approximately 220 revolutions per minute, then the pulse created by the fluid leaving the nozzle would tactually be perceived as a steady stream. The sensation of a pulsating action is desired to re-create the effect of a manual massage.

The fluid re-enters the tubing at an outlet formed in a second drain fitting 32'. The fluid flows from the bladder 24 into a chamber 74, through an S-shaped coupling 80 and back into the pump 30. Fluid can be diverted from this normal circulation pattern by forming an aperture 82 in the bottom wall of the chamber 74 for fluid flow towards the temperature stabilizer 90, as shown at FIG. 6. Within the temperature stabilizer 90, the fluid flows through a series of finned tubing 94 arrayed in layers 92. After the fluid flows for cooling through the temperature stabilizer 90, the fluid is pulled, or sucked, out of the temperature stabilizer 90 by action of a vacuum created by the normal flow of fluid through the S-shaped coupling 80 between the chamber 74 and the pump 30. This vacuum is created by fluid flowing past a nipple 76. The fluid from the temperature stabilizer 90 is pulled out the nipple 76 and into the main stream of fluid flow into the pump 30.

A rocker switch on a control panel 112, can control the activation of a solenoid-activated valve 50, or valves, that divert flow from the main stream of flowing fluid. This diverts the flow from entering the distributor 40. Therefore, the pulses created by the flow of the fluid through the tubing and out the fluid dissipator 40,40',40" are lessened. It is important to note that there is a constant amount of fluid in the bladder. Diverting flow from the distributor 40 does not result in less fluid in the bladder. This is possible because as fluid is pushed out of the distributor 40,40',40", an equal amount of fluid leaves the bladder 24 by way of the second drain fitting 32'. Use of the unit without diverting fluid flow through solenoid-activated valve 50 means fluid leaves the fluid distributor 40,40',40" at full power. Use of one solenoid-activated valve 50 reduces the pressure exerted by the pulse as it flows out the fluid dissipator 40,40',40". Use of more than one solenoid-activated valves reduces the pressure further.

The pump 30 is mounted within the cabinet 18 by means of a pump mount 31. Electrical means 110 are mounted also within the cabinet 18 for powering the pump 30, the temperature stabilizer 90, and the solenoid-activated valve 50. Main power is conveyed to the electrical means at 110' shown in detail at FIG. 6. Elements 30', 90', 50' and 112' are means by which power is conveyed to the pump, temperature stabilizer, solenoid actuated valve, and control panel, respectively.

The previously described versions of the present invention have many advantages including the home-use feature of the present invention. Use of these embodiments of the invention in a massage table, because of the reduced weight and size of the unit in comparison with other versions of massage tables, is designed for home use. The small size allows installation of the unit wherever the user has wall space with a nearby electrical outlet. No additional plumbing is required for installation of this embodiment. The user treats the massage table with the present embodiments as an additional piece of furniture when planning installation of such a massage table into an existing room. Because of the unit's light weight, no structural considerations need be made and therefore, is appropriate for home use. Also, because it is more economically produced, increased numbers of people are able to purchase such a device for home use.

An important advantage of the present invention is the addition of a novel fluid distributor 40. The distributor 40 consists of a nozzle 42 having an opening 44,46 at two ends for the passage of fluid therethrough. Associated with the nozzle 42 is a blade 64 which is fixedly attached, on a generally parallel plane, to the nozzle 42. This inverted C-shaped blade 64 catches the fluid and acts as a brake to the rotating nozzle 42, counter-balancing the nozzle 42 on the bushing 54 which receives the fluid distributor 40 for mounting. Additionally, use of the blade 64 introduces an second pulse into the fluid. Because of the proximity of the distributor 40 to the upper edge of the bladder 24, this second pulse is tactually experienced by the massage table user.

Another advantage of the embodiment of this invention is the temperature stabilizing feature. The continuous use of the pump 30 can add heat to the fluid circulating therethrough. The temperature stabilizer 90 can be used to dissipate the heat so generated.

The creation of a vacuum by flowing fluid past a nipple 76 causes an vacuum to be created within the nipple 76, sucking out the fluid from the temperature stabilizer 90 increasing the quietness of operation of the massage table with the present embodiments.

The variable massage pressures are achieved by use of a solenoid-activated bypass valve 50 which, when open, causes fluid to bypass being sent to the bladder 24. Additional solenoid activated values and associated bypass tubing can be added.

A waterbed-type heater, not shown, can be added to warm the fluid to a comfortable temperature. Additionally, a timer can be added to preset the duration of the massage generated by the table. Casters could be added to the legs 14 of the cabinet 18 to allow ease of transport of a massage table utilizing embodiments of the present invention within a home. A control panel 112 could be added to accommodate use of one or more than one solenoid-activated valves 50 to enable the user to have a "high, medium, low" fluid control capabilities.

What is claimed is:

1. A massage table comprising:

a) a bladder adapted for containing fluid;

b) tubing means retained within the bladder and adapted for circulating fluid;

c) a pump positioned adjacent said bladder and adapted for pressurizing fluid within said tubing means;

d) a fluid distributor, mounted for rotatable motion on said tubing means, adapted for providing a dual pulsating fluid motion in a desired direction, said fluid distributor further comprising a nozzle of hollow tubular construction, having an inlet and an outlet, the nozzle rotating about a vertical X axis defined by the center of said nozzle in position upon said tubing means in response to flow of fluid therethrough, the nozzle adapted for directing fluid in a generally vertical direction, for providing a first pulse toward an upper surface of the bladder, said fluid distributor having a blade mounted thereon and extending generally laterally from said nozzle, said blade adapted for directing and deflecting fluid in a generally vertical direction, providing a second pulse at each rotation of said nozzle; and e) fluid re-circulating means adapted for re-circulating fluid from said bladder into said tubing means, for recirculation of fluid through said tubing means.

2. The massage table of claim 1, further comprising a temperature stabilizer having an array of finned tubing, adapted for fluid circulation therein, and a blower for blowing ambient air over said finned tubing for conducting heat away therefrom.

3. In a massage table having a bladder adapted for containing fluid, means for supporting the bladder, tubing means retained within the bladder and adapted for fluid circulation therein, and a pump positioned adjacent the bladder and supported by the table, the pump adapted for fluid circulation through the tubing means, wherein the improvement comprises, at least one fluid distributor, having a nozzle mounted for rotatable motion on the tubing means within the bladder, the fluid distributor nozzle adapted for rotating in response to passage of fluid therethrough the fluid distributor nozzle adapted for providing dual pulsating motion to the user; and said fluid distributor nozzle has a blade fixedly attached and extending laterally from said nozzle, and adapted for fluid direction in a desired direction each time the fluid distributor nozzle rotates providing a second pulse motion to the user for a single rotation of the fluid distributor.

4. In a massage table of claim 3, wherein the improvement further comprises, a temperature stabilizer having an array of finned tubing, adapted for fluid circulation therein and a blower for blowing ambient air over said finned tubing for conducting heat away therefrom.

5. In a massage table having a bladder adapted for containing fluid, means for supporting the bladder, tubing means retained within the bladder and adapted for circulating fluid within the tubing means, and a pump adapted for circulating fluid through the tubing means, wherein the improvement comprises:

a) a fluid distributor mounted for rotatable motion on the tubing means, the fluid distributor adapted for rotating in response to fluid passage therethrough and into the bladder, for providing dual pulsating motion to the user;

b) a temperature stabilizer having an array of finned tubing and adapted for fluid circulation therethrough and a blower for blowing ambient air over the finned tubing for conducting heat away from the array of finned tubing; and c) second tubing means interconnecting the tubing means and the temperature stabilizer, adapted for providing fluid communication between tubing means and temperature stabilizer;

d) the fluid distributor further comprising a nozzle, mounted for rotational movement, the nozzle adapted as a fluid conduit, the nozzle rotating in response to being pushed by fluid flow through the nozzle and exiting from the nozzle providing a first pulse; and e) a blade fixedly attached to and extending laterally from the nozzle, the blade following the nozzle and powered by the nozzle rotation, the following blade rotating and deflecting bladder contained fluid retained in the bladder, providing a second pulse.

* * * * *